US008220909B2

(12) United States Patent
Domae

(10) Patent No.: US 8,220,909 B2
(45) Date of Patent: Jul. 17, 2012

(54) INK BAG ADAPTER, ADAPTER-EQUIPPED INK BAG, AND PRINTING APPARATUS

(75) Inventor: Yoshinori Domae, Chiba (JP)

(73) Assignee: Seiko I Infotech Inc. (JP)

( * ) Notice: Subject to any disclaimer, the term of this patent is extended or adjusted under 35 U.S.C. 154(b) by 409 days.

(21) Appl. No.: 12/454,572

(22) Filed: May 19, 2009

(65) Prior Publication Data

US 2009/0290001 A1 Nov. 26, 2009

(30) Foreign Application Priority Data

May 23, 2008 (JP) ..... 2008-135902

(51) Int. Cl.
*B41J 2/17* (2006.01)
*B41J 2/175* (2006.01)

(52) U.S. Cl. ..... 347/85; 347/84

(58) Field of Classification Search ..... None
See application file for complete search history.

(56) References Cited

U.S. PATENT DOCUMENTS 6,386,675 B2 * 5/2002 Wilson et al. ..... 347/19
6,416,166 B1 7/2002 Robinson et al. ..... 347/49
6,582,068 B2 * 6/2003 Ishizawa et al. ..... 347/85
7,237,880 B2 * 7/2007 Miyazawa et al. ..... 347/86

FOREIGN PATENT DOCUMENTS

| | | |
|---|---|---|
| EP | 1555128 | 7/2005 |
| EP | 1757456 | 2/2007 |
| WO | 2006072038 | 7/2006 |

* cited by examiner

*Primary Examiner* — Matthew Luu
*Assistant Examiner* — Renee I Wilson
(74) *Attorney, Agent, or Firm* — Adams & Wilks

(57) ABSTRACT

To position a storage medium simply/reliably. An ink bag unit is structured so as to be attachable to and detachable from a tray. When ink runs out, a new ink bag unit can be used by being mounted on the tray. An adapter portion holds a storage device that stores data regarding the ink. The adapter portion is inserted into an adapter insertion portion of the tray, whereby a position of the storage device in the ink cartridge is definitely determined. As described above, with regard to the ink cartridge, the tray can be used as a piece of equipment of a printing apparatus over and over again, and the ink bag unit can be distributed as a consumable article. Further, because the storage device is mounted to the adapter portion, connection between the printing apparatus and the storage device can be achieved reliably and easily when the ink cartridge is mounted to the printing apparatus.

19 Claims, 12 Drawing Sheets

INK BAG ADAPTER, ADAPTER-EQUIPPED INK BAG, AND PRINTING APPARATUS

BACKGROUND OF THE INVENTION

The present invention relates to an ink bag adapter, an adapter-equipped ink bag, and a printing apparatus, and for example, relates to an adapter attached to an ink bag that houses ink of an ink-jet type.

There is a large ink-jet type printer that ejects ink to a plastic sheet material such as, for example, a banner advertisement of a department store and signboard, and records (prints) characters and images thereon.

In this type of printer, the ink is supplied thereto by mounting an attachable/detachable ink cartridge thereon.

The ink cartridge is configured by storing the ink in an ink bag (containing bag) made of a flexible sheet material, and by housing the ink bag in a cartridge case made of a resin-made hard case.

A storage medium that stores information regarding the ink therein is attached to the ink bag, and the printer reads in the information to thereby make a determination, and prevents erroneous mounting of the ink cartridge.

Incidentally, it is conceivable that the ink bag of the ink takes a variety of postures in the cartridge case owing to the gravity and the inertial force. Accordingly, as illustrated in Japanese Patent No. 3838373, there is disclosed a technology for correcting a position of the storage medium in the cartridge case and preventing a positional shift of the storage medium.

This technology is one to attach, onto the ink bag, the storage medium and a board for positioning the storage medium, to fit a positioning hole formed in the board to a pin of the cartridge case, and to thereby position the storage medium to the cartridge case.

Heretofore, since the storage medium has been fixed to the flexible ink bag, a strict position correcting function has become necessary for an interface portion of the ink bag, which is connected to the storage medium, and there has been a problem that a structure and manufacturing process of the ink bag become complicated.

SUMMARY OF THE INVENTION

In this connection, it is an object of the present invention to surely perform the positioning of the storage medium by simple means.

In order to attain the above-mentioned object, the present invention provides an ink bag adapter, comprising:

an ink bag fixing portion fixed to a predetermined portion of an ink bag that reserves ink supplied to an ink ejection head;

an ink bag container fixing portion fixed to a predetermined portion of an ink bag container that houses the ink bag and is mounted on a printing apparatus; and a storage medium holding portion that, when being fixed to the ink bag container, holds a storage medium storing information regarding the ink in the fixed ink bag at a predetermined position.

A further object of the present invention is to provide the ink bag adapter, wherein the predetermined portion of the ink bag is an ink supply port that supplies the ink from the ink bag.

A further object of the present invention is to provide the ink bag adapter, further including: a recessed/protruding portion that is formed for each ink type of the fixed ink bag, and coincides with a recessed/protruding portion formed in the printing apparatus at a time when the ink bag container is mounted to the printing apparatus.

A further object of the present invention is to provide the ink bag adapter, wherein a shape of the ink bag container fixing portion is formed for each ink type of the fixed ink bag, and the ink bag container fixing portion can be fixed to a predetermined ink bag container adapted to the shape.

A further object of the present invention is to provide the ink bag adapter, further including: a positioning portion that is fitted to a fitting portion formed in the printing apparatus and positions the printing apparatus at a time when the ink bag container is mounted to the printing apparatus, wherein the positioning portion is fitted to a fitting portion formed so as to correspond to the positioning portion.

A further object of the present invention is to provide the ink bag adapter, further including: a pressing portion that presses a bonded portion hermetically sealing the ink bag to thereby holds the bonded portion in a sandwich manner.

It is another object of the present invention is to provide an adapter-equipped ink bag, comprising:

an ink bag that reserves ink supplied to an ink ejection head; and the ink bag adapter, the ink bag adapter being fixed to a predetermined portion of the ink bag.

It is another object of the present invention is to provide a printing apparatus, comprising: an ink bag container mounting means for mounting thereon an ink bag container that houses the adapter-equipped ink bag;

a predetermined information acquiring means for acquiring predetermined information regarding ink of the ink bag from a storage medium held on an ink bag adapter fixed to the mounted ink bag container;

a determining means for determining whether or not to use the ink of the ink bag, to which the ink bag adapter is fixed, by using the acquired predetermined information; and a printing means for performing printing on a printing medium by ejecting the ink reserved in the ink bag from an ink ejection head to the printing medium in a case where the determining means determines to use the ink.

According to the present invention, the storage medium is fixed to the ink bag adapter, whereby the positioning of the storage medium can be performed simply and surely.

BRIEF DESCRIPTION OF THE DRAWINGS

In the accompanying drawings:

FIGS. 2A and 2B are views illustrating exterior appearances of an ink cartridge, and the like;

FIGS. 3A and 3B are views illustrating a construction of an adapter portion, and the like;

FIGS. 7A and 7B are views illustrating a construction of an adapter portion according to the modification example, and the like.

DETAILED DESCRIPTION OF THE PREFERRED EMBODIMENTS

(1) Outline of Embodiment

Figure 1:
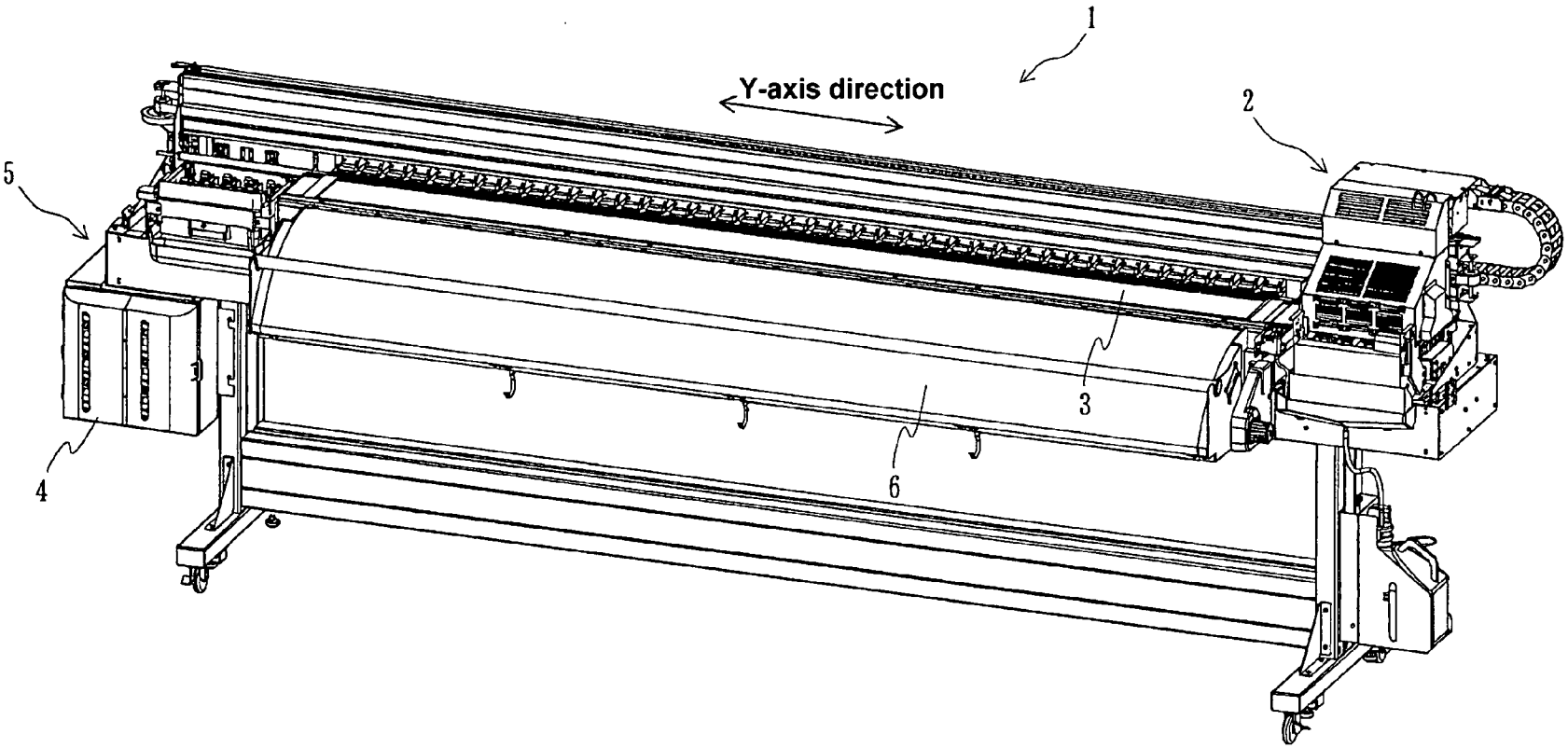
FIG. 1 is a view illustrating an exterior appearance of a printing apparatus.

An ink cartridge 8 (FIG. 2B) includes an ink bag unit 20 and a tray 10.

The ink bag unit 20 is formed so as to be attachable to and detachable from the tray 10. When ink runs out, a new ink bag unit 20 can be used by being mounted on the tray 10.

Further, the ink bag unit 20 is composed by mounting an adapter portion 30 on a spout member 28 of an ink bag 21.

The adapter portion 30 holds a storage device that stores data regarding the ink. The adapter portion 30 is inserted into an adapter insertion portion 12 of the tray 10, whereby a position of the storage device in the ink cartridge 8 is definitely determined.

As described above, with regard to the ink cartridge 8, the tray 10 can be used as a piece of equipment of a printing apparatus over and over again, and the ink bag unit 20 can be distributed as a consumable article.

Further, since the storage device is mounted to the adapter portion 30, connection between the printing apparatus and the storage device can be achieved surely and easily in the case of mounting the ink cartridge 8 on the printing apparatus.

(2) Details of the Embodiment

FIG. 1 illustrates an exterior appearance of a printing apparatus 1 according to this embodiment.

The printing apparatus 1 is a printing apparatus of a so-called ink-jet printer type, and for example, is used in the case of printing an advertisement and the like on a large plastic sheet.

The printing apparatus 1 includes a guide called a Y-rail in a Y-axis direction (longitudinal direction), in which a carriage 2 moves along the Y-rail.

A head (ink ejection head) is housed in an inside of the carriage 2. The head includes an ejection mechanism using piezoelectric elements and the like, and can eject ink from nozzles by driving the ejection mechanism.

A medium (recording medium) wound in a rolled shape can be mounted to the printing apparatus 1. For example, the medium is made of a plastic-made sheet and the like.

Then, the printing apparatus 1 conveys the medium onto a platen 3 by using a feeding mechanism, and ejects ink of a predetermined color from the head onto the medium while sliding the carriage 2 in the Y-axis direction, to thereby print a variety of characters, pictures and the like on the medium.

A heater is built in a media guide 6, and the medium subjected to such a printing process is heated while sliding on the media guide 6, whereby the ink is solidified.

An ink supply unit 5 is provided on one end of the printing apparatus 1, and on a front surface of the ink supply unit 5, a front cover 4 is provided so as to be openable and closeable.

When the front cover 4 is opened, a slot into which the ink cartridge is inserted is provided in the ink supply unit 5. The ink is supplied to the printing apparatus 1 by inserting the ink cartridge into the slot.

The printing apparatus 1 includes one that directly supplies the ink in the ink cartridge to the head by a pipe; and one that reserves the ink in the ink cartridge into a sub-tank once by a pump, and supplies the ink from the sub-tank to the head.

When the printing apparatus 1 is increased in size, a height difference between the ink cartridge and the head is increased. Accordingly, a method of appropriately adjusting a head value between the head and the ink by using the sub-tank is used in general.

Figure 2A:
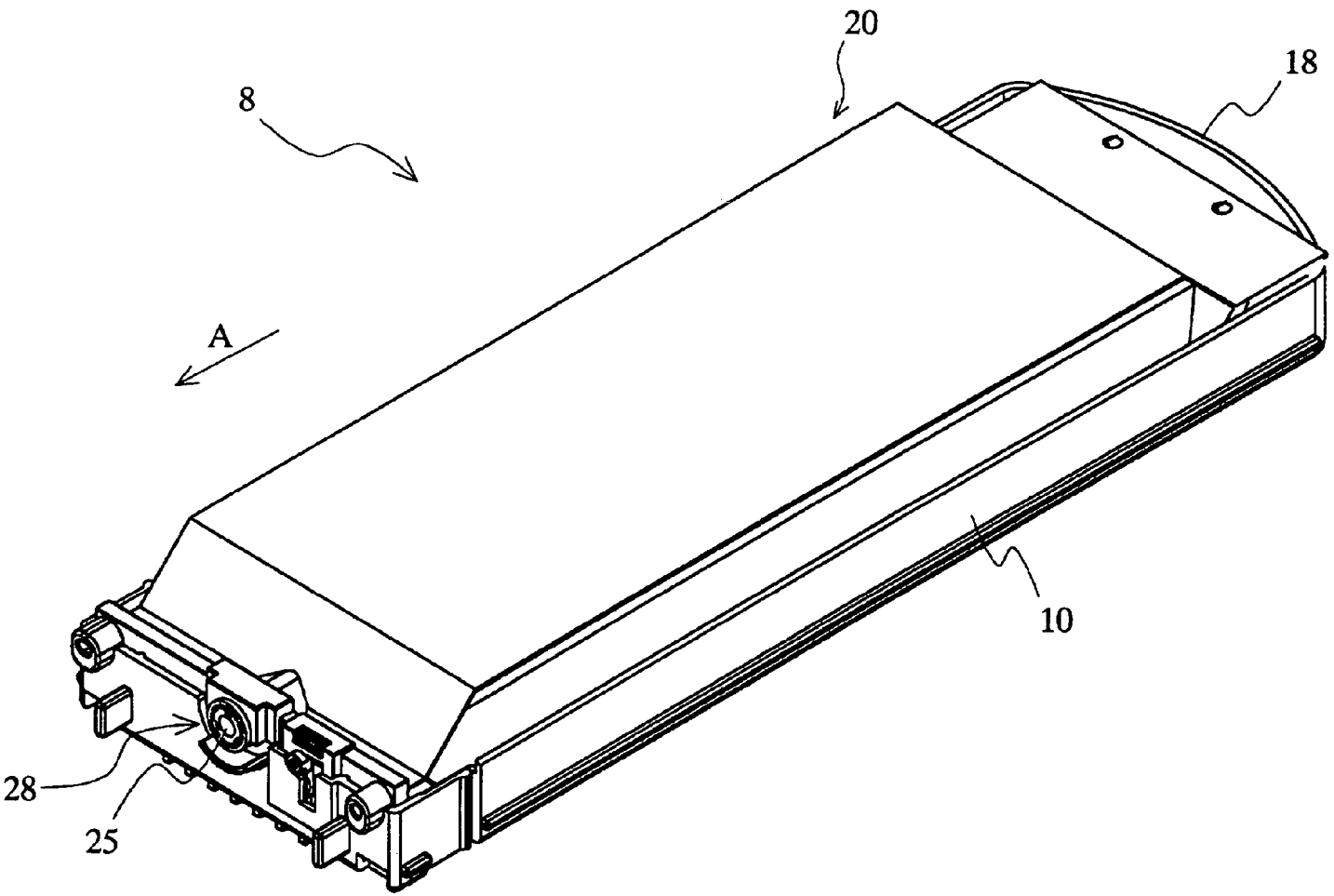

FIG. 2A is a view illustrating an example of the exterior appearance of the ink cartridge 8.

Broadly speaking, the ink cartridge 8 is made up of the ink bag unit 20 and the tray 10.

The ink cartridge 8 is inserted into the ink supply unit 5 (FIG. 1) in a direction of an arrow A illustrated in FIG. 2A.

A spout member 28 is provided on a center of an end portion of the ink cartridge 8 in the direction of the arrow A (insertion direction).

An ink supply port 25 that supplies the ink is provided on a center of the spout member 28. The ink supply port 25 is sealed at the time of being unused. However, when the ink cartridge 8 is inserted into the ink supply unit 5, a needle formed in the ink supply unit 5 pierces and breaks a sealed portion of the ink supply port 25, whereby the ink is supplied to the printing apparatus 1.

Meanwhile, on an end portion of the ink cartridge 8 in a direction reverse to such an arrow A direction, a handle portion 18 handled by a user at the time of pulling out the ink cartridge 8 from the ink supply unit 5 is formed.

In the following, for the ink cartridge 8, a side on which the spout member 28 is formed is referred to as a front portion, and a side on which the handle portion 18 is formed is referred to as a rear portion.

Figure 2B:
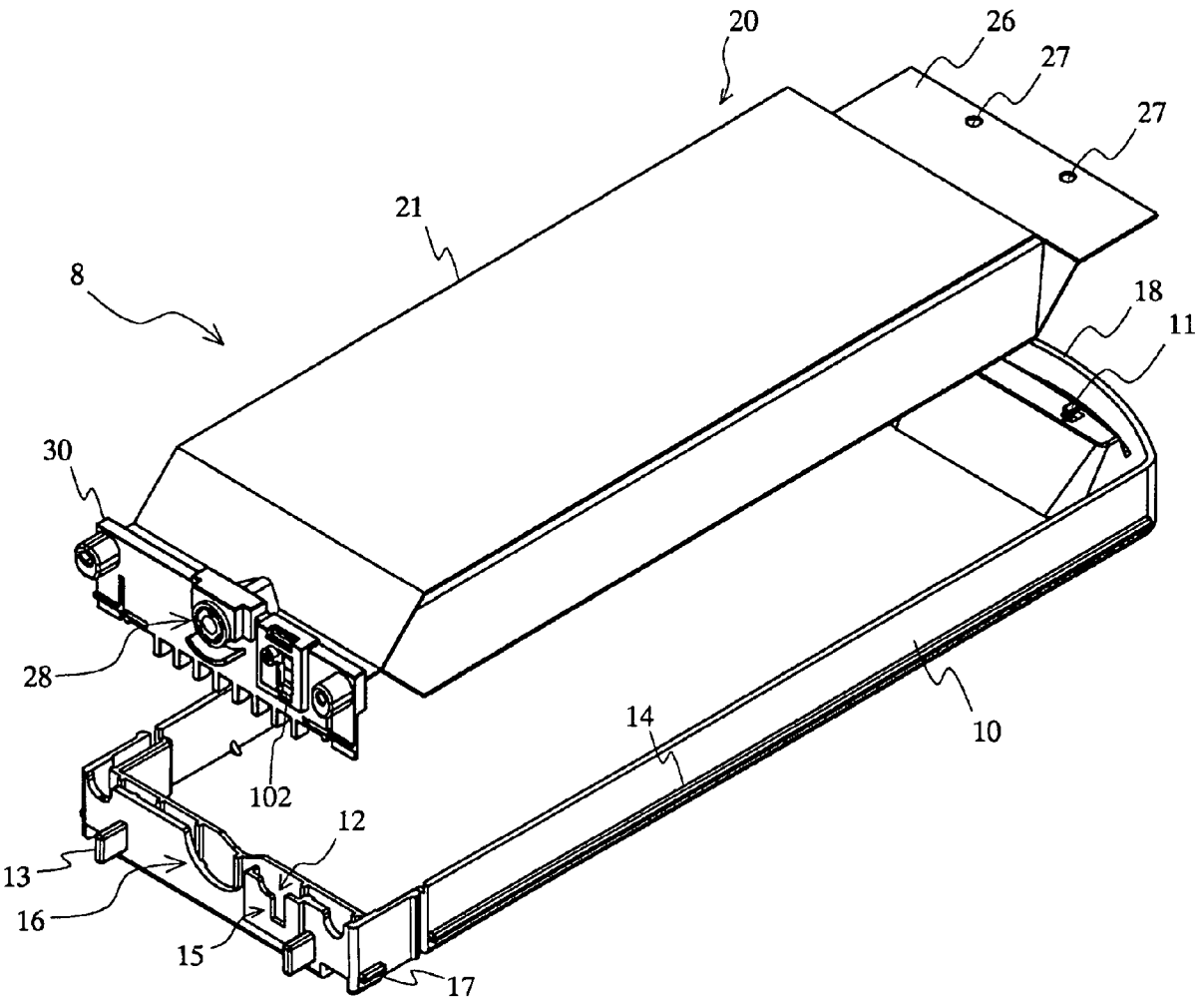

FIG. 2B is a view illustrating a state where the ink bag unit 20 is detached from the tray 10.

The tray 10 and the ink bag unit 20 are attachable to and detachable from each other. The tray 10 is provided as the piece of equipment equipped in the printing apparatus 1 and is repeatedly used, and the ink bag unit 20 is provided as the consumable article from an ink distributor.

Heretofore, the general mode has been that where an ink cartridge in which an ink bag is attached to a tray is supplied as the consumable article from the ink distributor. However, in this embodiment, the ink bag unit 20 just needs to be exchanged after separating the ink bag unit 20 and the tray 10 from each other, and accordingly, cost reduction can be achieved.

The ink bag unit 20 includes the ink bag 21 (liquid containing bag) and the adapter portion 30, and functions as an adapter-equipped ink bag.

The ink bag 21 is a hermetically sealed container that is flexible and includes the ink supply port 25 on one end thereof. The ink bag 21 is formed into a substantially rectangular parallelepiped in matching with a shape of the tray 10 in the case where the ink is fully filled therein, and when the ink is consumed, the ink bag 21 deforms so as to shrink in matching with such consumption of the ink.

In order to ensure strength, ink resistance and gas barrier property of the ink bag 21, as a material of the ink bag 21, there is used a flexible sheet material formed of a resin film, for example, of at least one type among polyethylene, polypropylene, polyethylene terephthalate, Nylon, polyvinyl chloride, polyvinylidene chloride, polyvinyl alcohol, and a copolymer of ethylene vinyl alcohol.

Further, in order to ensure more robust gas barrier property of the ink bag 21, foil of metal such as aluminum or a film on which the metal such as aluminum is evaporated is also provided as an intermediate layer thereof in some case.

On a rear end portion of the ink bag 21, a rear end bonded portion 26 that has a flat shape and is formed by hermetically sealing the sheet material by thermal welding is formed. Two fixed holes 27 are opened in the rear end bonded portion 26.

Meanwhile, the adapter portion 30 is attached to a front end portion of the ink bag 21. The adapter portion 30 functions as an ink bag adapter, and an attaching method and structure thereof are described later in detail.

The tray 10 is a resin-made rigid ink bag container (hard case), in which a recessed portion for housing the ink bag 21 is formed. The tray 10 can be inserted into the ink supply unit 5 in accordance with a guide formed on the slot of the ink supply unit 5.

As described above, the tray 10 functions as the ink bag container that houses the ink bag and is mounted to the printing apparatus, and also functions as a cartridge case.

On a rear end portion of the tray 10, two fixing protrusions 11 are formed so as to correspond to the fixed holes 27. The fixing protrusions 11 engage with the fixed holes 27 of the ink bag 21, and thereby position and fix the rear end portion of the ink bag 21.

Meanwhile, on a front end portion of the tray 10, a slot-like adapter insertion portion 12 that receives and fixes the adapter portion 30 is formed.

When the adapter portion 30 is inserted into the adapter insertion portion 12, the front end portion of the ink bag 21 is positioned/fixed to the tray 10.

Further, a recessed portion 16 is formed on a front portion of the tray 10. When the adapter portion 30 is mounted on the adapter insertion portion 12, the spout member 28 is exposed in an insertion direction of the tray 10.

Further, as described later, the storage device can be mounted to the adapter portion 30. An electrode hole 15 is formed on a front surface of the tray 10 so that an electrode of the storage device can be exposed and brought into contact with an electrode of the printing apparatus 1.

As described above, since the adapter portion 30 is positioned to the tray 10, such an electrode 102 is also positioned to the tray 10.

Besides the above, on the tray 10, there are formed: tray guides 14 which guide the ink cartridge 8 along grooves of the ink supply unit 5 at the time of inserting the ink cartridge 8 into the ink supply unit 5; abutting protruding portions 13 which abut the ink supply unit 5 when the ink cartridge 8 is mounted on the tray 10; a tray fixing portion 17 that fixes the ink cartridge 8 at a position where the abutting protruding portions 13 abut the ink supply unit 5.

Figure 3A:
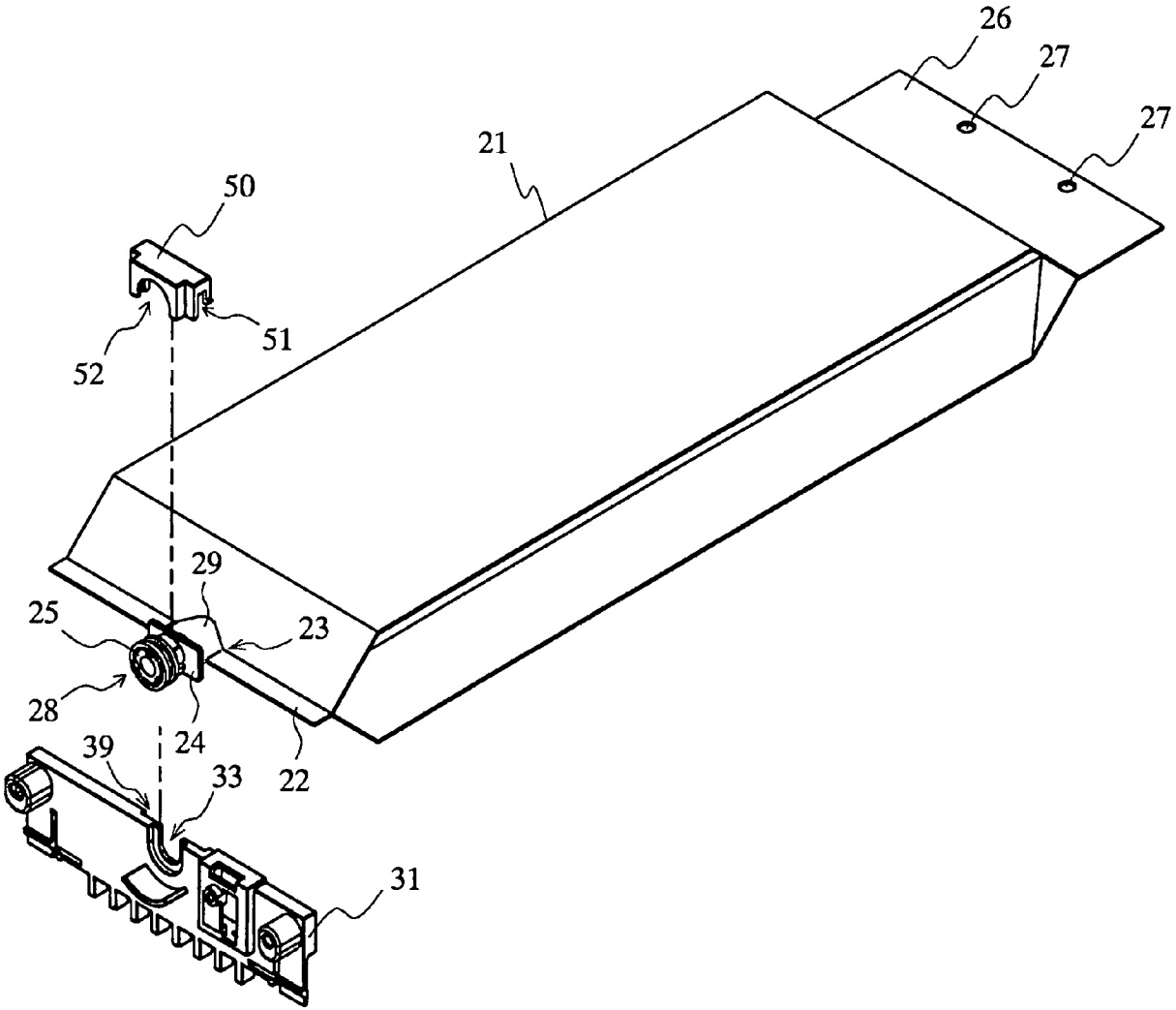

FIG. 3A is a view illustrating a construction of the adapter portion 30.

On the front end portion of the ink bag 21, a front end bonded portion 22 that has a flat shape and is hermetically sealed by being pasted by the thermal welding in a similar way to the rear end bonded portion 26 is formed.

As described above, the ink bag 21 is formed into the bag-like hermetically sealed container by hermetically sealing the front end portion and rear end portion of the cylindrical sheet material.

The spout member 28 is attached to the center of the front end bonded portion 22.

The spout member 28 is a substantially cylindrical cylinder member that is formed of resin or the like and has two opening portions. One of the opening portions constitutes the ink supply port 25, and the other opening portion is formed in an inside of the ink bag 21.

The ink in the ink bag 21 is supplied from the ink supply port 25 via the spout member 28 to the printing apparatus 1.

In the periphery of the spout member 28, the front end bonded portion 22 is fixedly adhered to the spout member 28 by the thermal welding and so on, and such a fixedly adhered portion of the front end bonded portion 22 forms a boat-shaped portion 29 curved into a cylindrical surface shape along a shape of the spout member 28.

Boundary portion 23 between the front end bonded portion 22 and the boat-shaped portion 29 is a portion where the ink bag 21 is prone to tear, and a reinforcing method of the boundary portion 23 is described later in a modification example.

On a portion of the spout member 28, which protrudes from the ink bag 21, there is formed a small collar portion 24 that has a plane perpendicular to a central axis of the spout member 28 and extends in a direction where the front end bonded portion 22 is formed.

The adapter portion 30 includes a stopper 50 and a collar member 31, which hold the above-described spout member 28 in a sandwich manner from up-and-down directions, respectively (a side facing a bottom of the ink bag 21 is a lower side).

The collar member 31 is a plate-like member with a substantially rectangular shape. The collar member 31 is attached to the spout member 28 so that a plate surface thereof can be perpendicular to a centerline of the spout member 28, and that a longitudinal direction thereof can coincide with the direction in which the front end bonded portion 22 is formed.

On a center of the collar member 31, there are formed: a lower spout-receiving portion 33 that has a recessed shape and is formed into a curve adapted to an outer circumferential surface of the spout member 28 and a small-collar insertion portion 39 that receives and engages with the small collar portion 24.

Meanwhile, also on the stopper 50, there are formed an upper spout-receiving portion 52 that has a recessed shape and is formed into a curve adapted to the outer circumferential surface of the spout member 28 and a small-collar insertion portion 51 that receives and engages with the small collar portion 24.

Figure 3B:
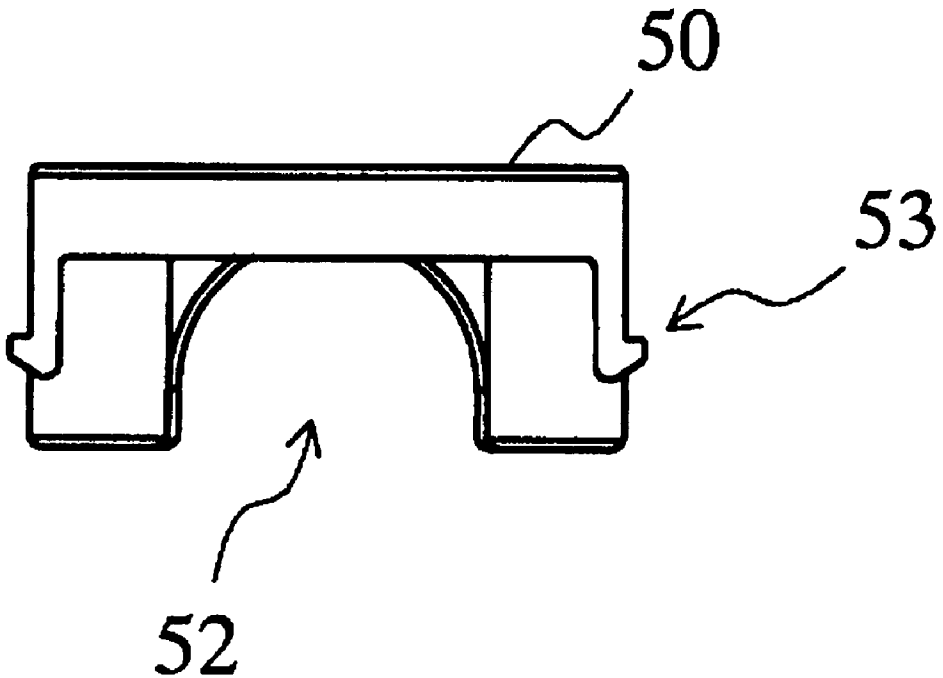

As illustrated in FIG. 3B, stopper fixing hooks 53 are formed on the stopper 50. When the stopper 50 is mounted on the collar member 31, the stopper fixing hooks 53 engage with recessed portions (not shown) of the collar member 31, whereby the stopper 50 is fixed to the collar member 31.

The stopper fixing hooks 53 are located in the rear of the collar member 31, and engage with the recessed portions of the collar member 31 in the rear of the collar member 31.

In the ink bag unit 20, the ink bag 21 is located in the rear of such an engagement portion between the stopper 50 and the collar member 31, and accordingly, it becomes difficult to detach the stopper 50 by touching this portion. In such a way, the adapter portion 30 can be suppressed from being disassembled fraudulently.

The collar member 31 and the stopper 50, which are structured as described above, are used, whereby the collar member 31 is mounted and fixed to the spout member 28 from below, and the stopper 50 is mounted and fixed to the spout member 28 from above. Then, movement of the spout member 28 in a direction perpendicular to the centerline thereof is regulated by the lower spout-receiving portion 33 and the upper spout-receiving portion 52, and the small collar portion 24 engages with the small-collar insertion portion 39 and the small-collar insertion portion 51, whereby movement of the spout member 28 in such a direction perpendicular to the centerline is regulated.

In such a way, the spout member 28 can be fixed to the collar member 31 by using the stopper 50, and the ink bag unit 20 in which the ink bag 21 and the adapter portion 30 are integrated with each other is formed.

As described above, in the adapter portion 30, the lower spout-receiving portion 33, the upper spout-receiving portion 52, the small-collar insertion portion 51 and the like function as ink bag fixing portions fixed to a predetermined portion (ink supply port that supplies the ink from the ink bag) of the ink bag. Further, the collar member 31 functions as an ink bag container fixing portion fixed to a predetermined portion (adapter insertion portion 12) of the ink bag container that houses the ink bag and is mounted to the printing apparatus 1.

Figure 4A:
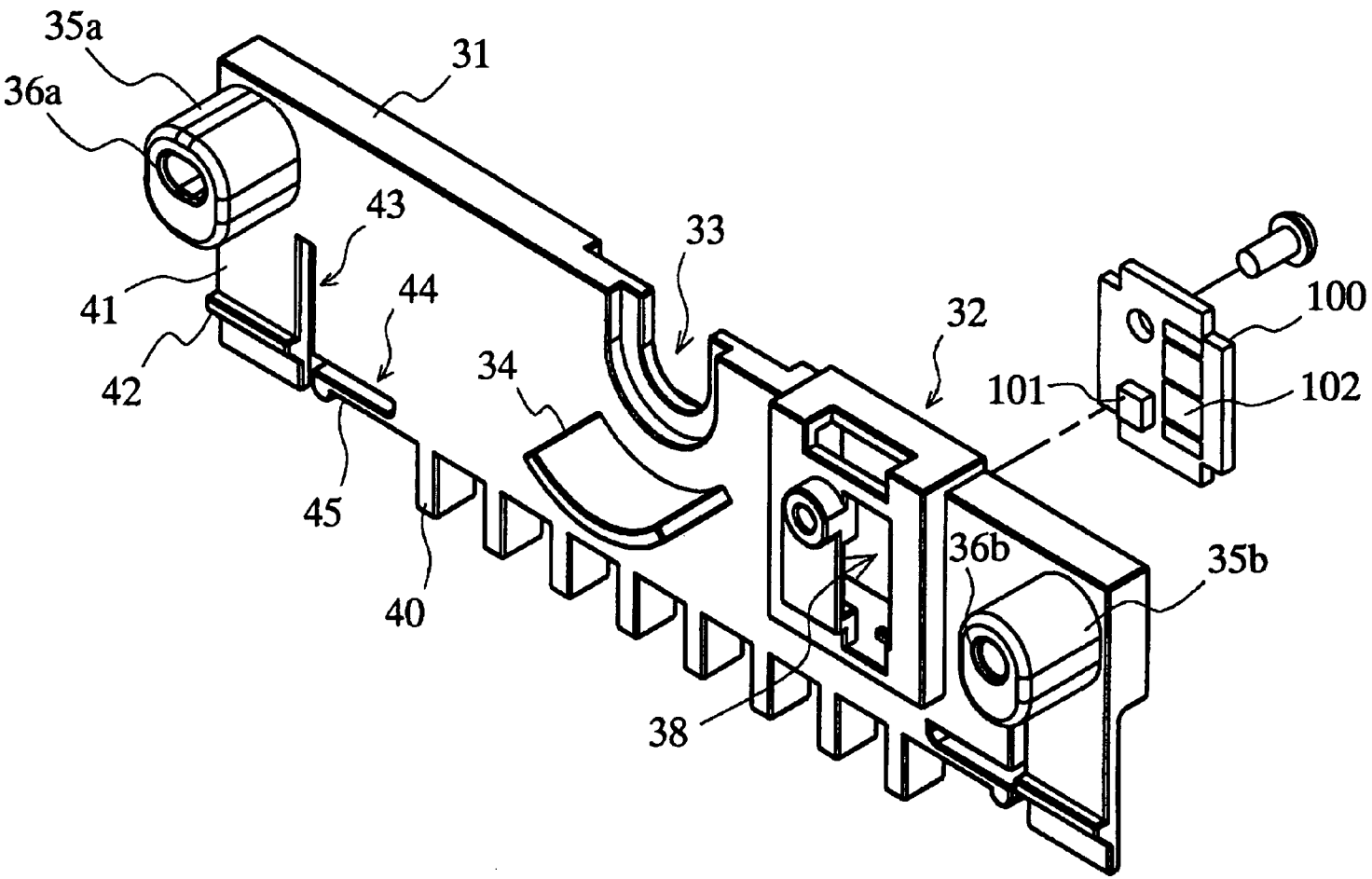
FIGS. 4A and 4B are views illustrating an exterior appearance of a collar member.
Figure 4B:
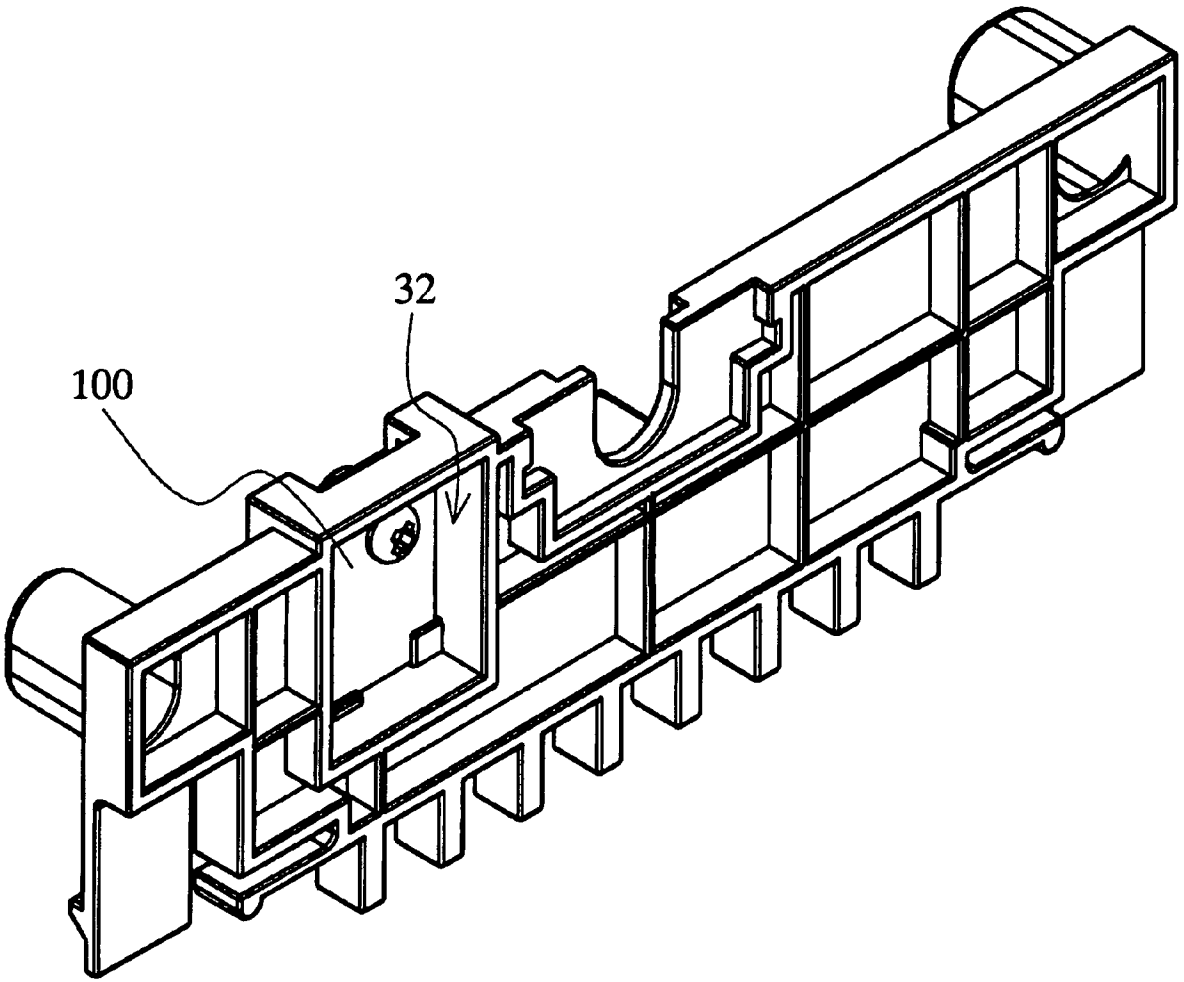

FIG. 4A illustrates a perspective view where the collar member 31 is viewed from the front, and FIG. 4B illustrates a perspective view where the collar member 31 is viewed from the rear.

On an upper center of the collar member 31, the lower spout-receiving portion 33 that fixes the spout member 28 (not shown) is formed. Below the lower spout-receiving portion 33, there is formed an ink receiving portion 34, which receives the ink dropped from the ink supply port 25 in the case where the ink happens to drop therefrom.

On one end side of the collar member 31, a slit 43 is formed upward from a lower end thereof, whereby a collar fixing portion 41 is formed on one end of the collar member 31.

The collar fixing portion 41 can be flexibly bent in the fore-and-aft direction. When the collar fixing portion 41 is flexibly bent, a force to restore the collar fixing portion 41 to its original shape acts thereon by the elasticity of the collar fixing portion.

Then, when the collar member 31 is attached to the tray 10 (not shown), a fixing hook 42 formed on a tip end side of the collar fixing member 41 engages with a recessed portion of the tray 10 by such a restoration force. In such a way, the collar member 31 is fixed to the tray 10.

Also on the other end side of the collar member 31, another collar fixing portion 41 is formed in a similar way. The collar member 31 engages with such recessed portions of the tray 10 on both end sides thereof.

Further, on a lower end side of the collar member 31, a slit 44 that communicates with the slit 43 and is formed in the longitudinal direction of the collar member 31 is provided, and a repulsive portion 45 is formed adjacent to the collar fixing portion 41.

The repulsive portion 45 can be bent in the up-and-down direction. When the repulsive portion 45 is flexibly bent, force to restore the repulsive portion 45 to its original shape acts thereon by the elasticity of itself the repulsive portion.

In the case where the collar member 31 is attached to the tray 10, the repulsive portions 45 are flexibly bent to the slits 44 side, and elastic force acts on the repulsive portions 45 in a direction of detaching the collar member 31 from the tray 10.

When the user detaches the ink bag unit 20 from the tray 10, such detachment becomes easy owing to this elastic force.

A similar repulsive portion is also formed on the other end side of the collar member 31, and repulsive forces act on both ends of the collar member 31.

On the one end side of the collar member 31, a positioning marker 35*a* that protrudes forward from the plate surface of the collar member 31 is formed. A positioning hole 36*a* is formed in the positioning marker 35*a* in a protruding direction thereof.

The positioning hole 36*a* is formed at a position and into a shape, which are to fit to a protrusion on the printing apparatus 1 side when inserting the ink cartridge 8 into the ink supply unit 5.

Further, also on the other end side of the collar member 31, similar positioning marker 35*b* and positioning hole 36*b* are formed, and position/shape of the positioning hole 36*b* are position/shape at which the printing apparatus 1 adapts to this protrusion.

Further, in the case where the positions/shape of the positioning holes 36*a* and 36*b* and positions/shape of the protrusions of the printing apparatus 1 do not coincide with each other, the protrusions on the printing apparatus 1 side abut on the positioning markers 35*a* and 35*b*, whereby the ink cartridge 8 cannot be mounted to the ink supply unit 5.

Here, a reason why the positioning markers 35*a* and 35*b* are protruded is to prevent breakage of the protrusions of the printing apparatus 1 by forming the protrusions thereof to be short.

As described above, in the printing apparatus 1, the positions/shape of the positioning holes 36*a* and 36*b* of the collar member 31 and the positions/shape of the protrusions on the printing apparatus 1 side are allowed to correspond to each other in a one-to-one relationship. In such a way, the ink cartridge 8 and the slot of the ink supply unit 5 are allowed to correspond to each other in the one-to-one relationship, and erroneous insertion of the ink cartridge 8 is prevented.

Further, since the collar member 31 is directly attached to the ink bag 21, the collar member 31 and the type of the ink correspond to each other in the one-to-one relationship. By such a mechanism, erroneous mounting of a different type of ink can be prevented.

Here, the type of the ink (ink type) refers, for example, to an attribute for identifying the ink attached to the printing apparatus 1, and the attribute includes a color of the ink, such as magenta, a material type of the ink, such as UV (ultraviolet) ink, solvent ink, aqueous ink, and the like.

In this embodiment, the positions/shape of the positioning holes 36*a* and 36*b* are allowed to correspond to the material type of the ink among the types of the ink in the one-to-one relationship, and erroneous insertion of the ink cartridge 8 containing ink of a different material is prevented.

Note that erroneous insertion of the ink cartridge 8 containing ink of a different color is prevented by ink color identifying markers 40 to be described later.

As described above, the collar member 31 is formed for each type of the ink in such a manner that the positioning holes 36*a* and 36*b* are allowed to correspond to the material type of the ink, and that the ink color identifying markers 40 are allowed to correspond to the color of the ink.

Note that the collar member 31 is not limited to such a construction in which the positioning holes 36*a* and 36*b* are allowed to correspond to the material type of the ink and the ink color identifying markers 40 are allowed to correspond to the ink color. The collar member 31 can be modified in various ways. For example, the collar member 31 can be modified into a construction in which the positioning holes 36*a* and 36*b* are allowed to correspond to the ink color and the ink color identifying markers 40 are allowed to correspond to the material type of the ink.

Further, by an IC chip 101 to be described later, the printing apparatus 1 determines the ink type, and senses the erroneous insertion of the ink cartridge 8. However, it is after the needle has already pierced the ink supply port 25 that the printing apparatus 1 senses the erroneous insertion by the IC chip 101.

Accordingly, in this embodiment, before the needle pierces the ink supply port 25, the erroneous insertion is prevented from occurring by using the positioning holes 36*a* and 36*b* and the ink color identifying markers 40.

As described above, the printing apparatus 1 includes fitting portions which fit to the positioning holes 36*a* and 36*b*, and the positioning holes 36*a* and 36*b* of the collar member 31 function as positioning portions which are fitted to the fitting portions formed in the printing apparatus and position the printing apparatus at the time when the ink bag container is mounted to the printing apparatus 1.

Then, the positioning portions are structured so as to be fitted to the fitting portions formed so as to correspond to the positioning portions.

Further, because the positioning holes 36*a* and 36*b* are provided at two spots, it is possible to prepare a large number of the collar members 31, the number of which is equivalent to the number of combinations of the positions/shapes of the positioning holes 36*a* and 36*b*. Even in the case where the number of ink cartridges 8 is increased by an increase of the ink type, a plurality of the ink cartridges 8 corresponding to the number of ink cartridges 8 can be prepared.

Between the lower spout-receiving portion 33 and the positioning hole 36*b*, there is provided a storage device attaching portion 32 to which a storage device 100 is mounted.

The storage device attaching portion 32 is formed by forming a recessed portion from a back side (that is, a side on which the ink bag 21 is attached) of the collar member 31. On a bottom surface of the recessed portion, an opening portion 38 is formed so that the electrode 102 of the storage device 100 can be exposed to a front surface side of the collar member 31.

The storage device 100 is structured by arranging the IC chip 101 and the electrode 102 on a board.

A readable/writable storage medium such as an EEPROM (Electrically Erasable and Programmable ROM) is built in the IC chip 101. In the storage medium, information regarding the ink of the ink bag 21 to which the collar member 31 is attached is stored therein.

In the information regarding the ink, there are information for allowing the printing apparatus 1 to specify the ink, such as the ink color, the ink type, a manufacturer thereof, and a date of production thereof, and information for controlling the ink, such as a residual amount of the ink, which is written as a record by the printing apparatus 1.

The printing apparatus 1 is provided with a function to access the IC chip 101 and judge whether or not correct ink is mounted thereon in the case where the ink cartridge 8 is mounted thereon, and to prevent the erroneous mounting of the ink by issuing a warning in the case where the ink is incorrect.

The electrode 102 is connected to an electrode of the IC chip 101. The electrode 102 is brought into contact with the electrode on the printing apparatus 1 side, whereby the IC chip 101 and the printing apparatus 1 are allowed to transmit/receive an electrical signal.

In the case of such a mode of pasting the storage device 100 on the ink bag 21 as in the background art, it has been necessary to use a contactless-type IC chip because a position of the storage device 100 has not been definitely determined. However, in the case of this embodiment, a position of the electrode 102 with respect to the electrode of the printing apparatus 1 is definitely determined because the storage device 100 is fixed to the collar member 31, and accordingly, the contact-type electrode 102 can be used.

As described above, the storage device attaching portion 32 functions as a storage medium holding portion that holds, in the case where the adapter portion 30 is fixed to the ink bag container, the storage medium (storage device 100) storing the information regarding the ink in the thus fixed ink bag at a predetermined position.

In the case of the contactless type, there is a necessity to provide a reader/writer or the like, which wirelessly transmits/receives the electrical signal, in the printing apparatus 1. However, in this embodiment, this necessity is eliminated, and accordingly, cost reduction can be achieved.

Note that, though the connection between the IC chip 101 and the printing apparatus 1 is achieved by the contact-type electrode 102 in this embodiment, the electrode 102 can also be made into the contactless type.

Further, in the case of the mode of pasting the storage device 100 on the ink bag 21 as in the background art, in the case where the ink bag 21 falls down and collides with a floor from the storage device 100, weight of the ink bag 21 is applied to the storage device 100, and there is a risk that the storage device 100 may break. However, in this embodiment, the storage device 100 is fixed to an inside (ink bag 21 side) of the collar member 31, and accordingly, even if the ink bag 21 falls down, an impact can be prevented from being directly applied to the storage device 100.

The IC chip 101 is attached to the storage device attaching portion 32 from the rear of the collar member 31, and is screwed thereto.

In the ink bag unit 20, because the ink bag 21 is located in the rear of the storage device attaching portion 32, it becomes difficult to detach the storage device 100 by unscrewing the storage device 100. In such a way, falsification by exchange of the IC chip 101 can be suppressed.

Further, on the lower end of the collar member 31, the ink color identifying markers 40 formed of a plurality of protrusions (pins) are formed.

A plurality of (for example, eight) pieces of the ink color identifying markers 40 are formed. In a manufacturing process of the ink bag unit 20, a piece of the ink color identifying markers 40, which corresponds to the ink color, is broken. For example, a first piece from the left is broken if the ink color is black, and a second piece is broken if the ink color is yellow.

By this manufacturing process, the ink bag unit 20 in which the ink color identifying marker 40 corresponding to the ink color is chipped off is formed.

The ink color identifying markers 40 which are not broken penetrate marker insertion holes (described later) formed on a bottom surface of the tray 10, and protrude from the bottom surface of the tray 10.

Meanwhile, in the slot of the ink supply unit 5 provided in the printing apparatus 1, a protruding portion that corresponds to a portion of the chipped-off ink color identifying marker 40 at the time of mounting the ink cartridge 8 thereon is provided. When the ink cartridge 8 of a different color is attempted to be inserted into the slot, the protruding portion of the slot abuts on the ink color identifying marker 40, and the ink cartridge 8 cannot be inserted into the slot.

In the above description, the ink color identifying marker 40 is broken, whereby a recessed portion is provided on the collar member 31, and the protruding portion that coincides therewith is provided on the slot of the ink supply unit 5. However, on the contrary, a construction can also be adopted, in which a protruding portion is provided on the collar member 31, and a recessed portion that coincides therewith is provided on the slot side.

As described above, the adapter portion 30 includes the recessed/protruding portion, which is formed of the ink color identifying marker 40 for each ink type of the ink bag fixed thereto, and coincides with the recessed/protruding portion formed on the printing apparatus 1 at the time when the ink bag container (tray 10) is mounted to the printing apparatus 1.

Figure 5A:
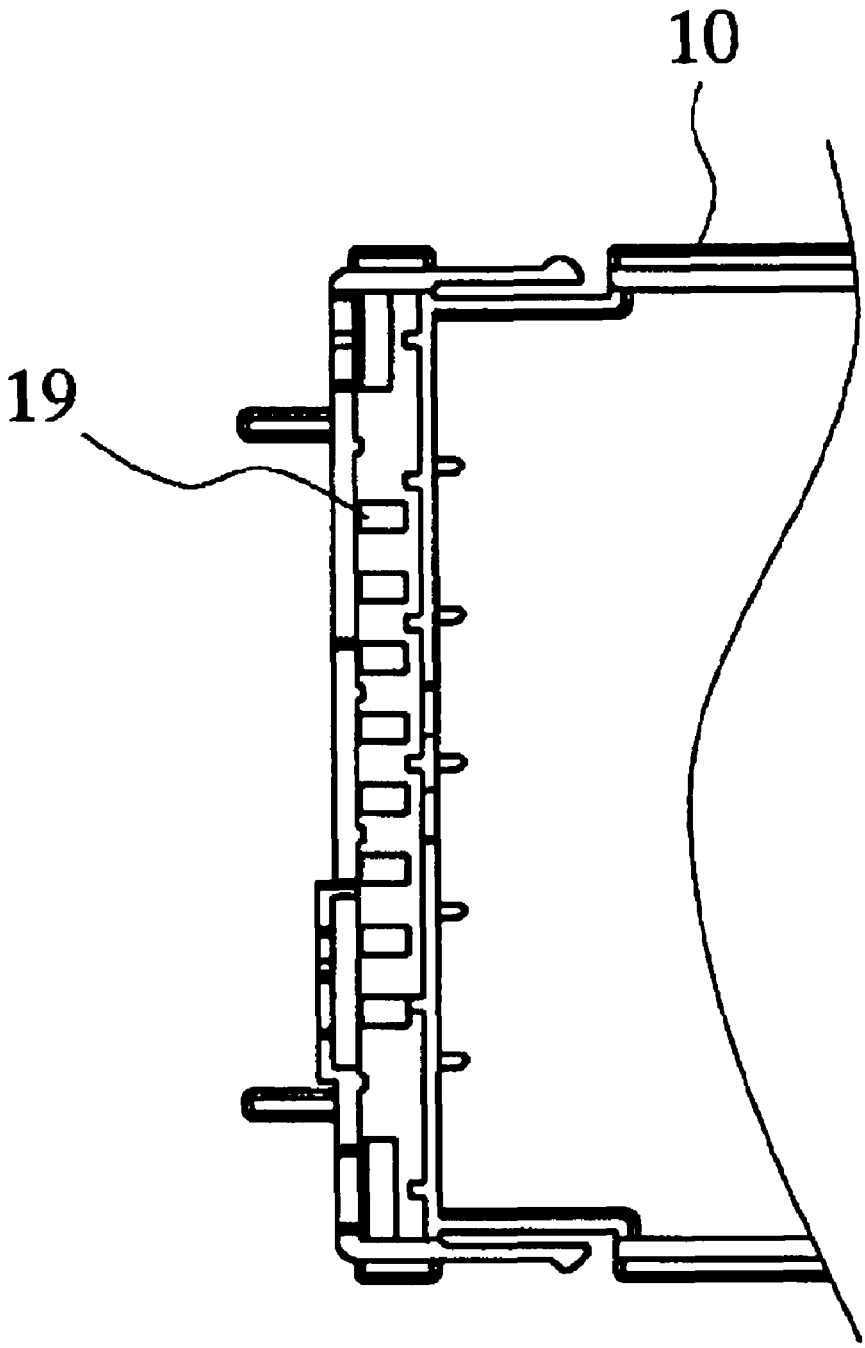
FIGS. 5A and 5B are views illustrating marker insertion holes and the like of the ink cartridge.

FIG. 5A is a view illustrating a state where marker insertion holes 19 of the ink cartridge 8 are viewed from an upper surface of the tray 10.

As illustrated in this drawing, on the bottom surface of the tray 10, the marker insertion holes 19 penetrated by the ink color identifying markers 40 are formed so as to correspond to the ink color identifying markers 40 before being broken.

Figure 5B:
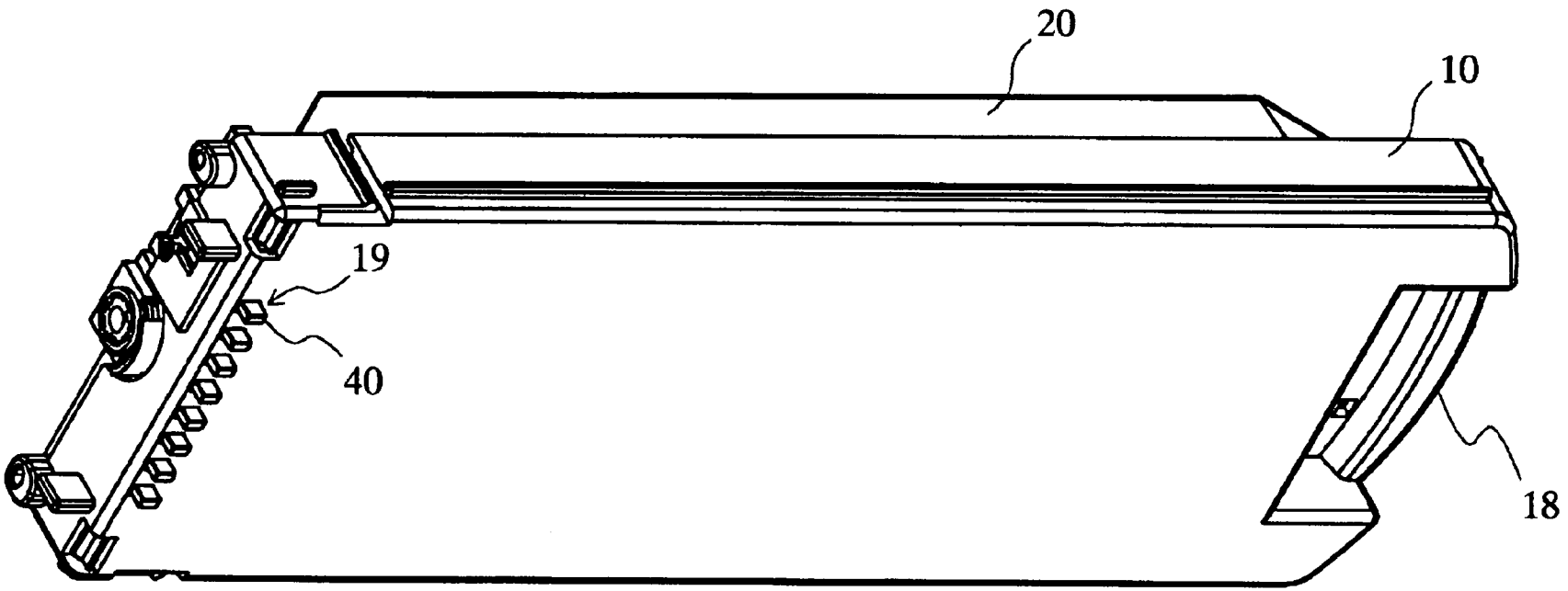

Then, when the ink bag unit 20 is mounted on the tray 10, as illustrated in FIG. 5B, the unbroken ink color identifying markers 40 protrude from the bottom surface of the tray 10.

Accordingly, when the ink cartridge 8 of a different color is inserted into the slot of the ink supply unit 5, the protruding portion on the printing apparatus 1 side abuts on the protruding ink color identifying marker 40, and therefore, only the ink cartridge 8 of a designated color is allowed to be mounted on the slot. In such a way, the erroneous mounting of the ink cartridge 8 can be prevented.

As described above, such a construction is adopted, in which the marker insertion holes 19, of which number is equivalent to the number of ink color identifying markers 40 before being broken, are formed, and are penetrated by the ink color identifying markers 40. Then, the tray 10 can be provided with commonality among all the colors, and manufacturing cost of the tray 10 can be reduced. Further, management work of the user for the tray 10 can also be reduced.

Note that it is also possible to form only one marker insertion hole 19 without forming the marker insertion holes 19 so as to correspond to the individual ink color identifying markers 40.

As described above, in the adapter portion 30 (FIG. 2B), on the front surface thereof, the ink supply port 25, the positioning markers 35*a* and 35*b*, and the electrode 102 of the IC chip 101 are provided, and on the lower end thereof, the ink color identifying markers 40, by which the color of the ink as a content in the ink bag 21 is identified, are provided.

Meanwhile, in the tray 10, opened are spots thereof corresponding to those components provided on the front surface of the adapter portion 30, and spots thereof corresponding to the ink color identifying marker 40 before being broken. When the adapter portion 30 is inserted into the adapter insertion portion 12, and the fixing protrusions 11 are engaged with the fixed holes 27, then the ink cartridge 8 is completed.

Next, a description is made of a modification example of the ink color identifying markers 40.

In the above description, the ink color identifying marker 40 is allowed to coincide with the protruding portion formed in the slot of the ink supply unit 5. In this modification example, a marker insertion hole 19 that corresponds to the ink color identifying marker 40 is formed in the tray 10, and the ink bag unit 20 and the tray 10 are allowed to correspond to each other in the one-to-one relationship.

In this case, in the manufacturing process of the ink bag unit 20, the ink color identifying markers 40 other than the ink color identifying marker 40 corresponding to the ink color is removed by being broken.

Meanwhile, in the tray 10, the marker insertion hole 19 is provided at a position coinciding with the ink color identifying marker 40 that is not broken so as to correspond to the ink color.

In such a way, on the tray 10, the ink bag unit 20 of a different color is not allowed to be mounted by the ink color identifying marker 40.

Note that, when a recessed portion coinciding with the ink color identifying marker 40 that protrudes from the tray 10 is provided on the slot side, the erroneous mounting of the ink cartridge 8 on the slot can also be prevented.

As described above, the shape of the ink bag container fixing portion (collar member 31) is formed for each ink type of the ink bag by the ink color identifying marker 40, and the ink bag container fixing portion can be fixed to the predetermined ink bag container (tray 10) adapted to the shape thereof.

Such effects as described below can be obtained by the embodiment constructed as described above.

(1) Because the ink bag unit 20 can be attached to and detached from the tray 10, the ink bag unit 20 can be distributed and discarded as the consumable article, and the tray 10 can be used as the piece of equipment to be reused. In such a way, a price of the ink offered to the user can be suppressed.

(2) Because the storage device 100 is attached to the adapter portion 30, the position of the storage device 100 is definitely determined on the ink cartridge 8. Accordingly, the contact-type electrode can be used for the printing apparatus 1.

(3) Because the storage device 100 is attached to the inside of the adapter portion 30 in the ink cartridge 8, the storage device 100 also has sufficient resistance to the external impact.

(4) The ink color identifying marker 40 chipped off for each color is provided on the adapter portion 30, and the protruding portion that coincides with the chipped-off ink color identifying marker 40 is provided in the slot, whereby the ink cartridge 8 and the slot can be allowed to correspond to each other in the one-to-one relationship. In such a way, the erroneous mounting of the ink can be prevented.

(5) The ink color identifying marker 40 that protrudes for each color is provided on the adapter portion 30, and the marker insertion hole 19 adapted thereto is provided on the tray 10, whereby the ink bag unit 20 and the tray 10 can be allowed to correspond to each other in the one-to-one relationship. In such a way, the erroneous mounting of the ink can be suppressed.

(6) The positioning markers 35*a* and 35*b* are provided on the adapter portion 30, whereby the slot of the ink supply unit 5 and the ink cartridge 8 can be allowed to correspond to each other in the one-to-one relationship. In such a way, the erroneous mounting of the ink can be prevented.

Note that the printing apparatus 1 includes: an ink bag container mounting means (ink supply unit 5) for mounting thereon the ink bag container that houses the adapter-equipped ink bag; a predetermined information acquiring means for acquiring, by being connected by the electrode 102 to the storage medium (storage device 100) held on the ink bag adapter fixed to the ink bag container, the information regarding the ink of the ink bag from the storage medium; a determining means for determining whether or not to use the ink of the ink bag, to which the ink bag adapter is fixed, by using the acquired predetermined information; and a printing means for performing printing on a printing medium by ejecting the ink reserved in the ink bag from the ink ejection head to the printing medium concerned in the case where the determining means determines to use the ink.

Next, a description is made of the modification example of this embodiment.

For example, when the ink bag 21 falls down and is applied with a large impact, it is conceivable that the boundary portions 23 (FIG. 3A), the front end bonded portion 22, or the boat-shaped portion 29 tears.

In particular, the boundary portions 23 are the weakest portions among them, and it is extremely important to reinforce those regions from a viewpoint of stably supplying the ink bag unit 20.

In this connection, in this modification example, those portions are reinforced by being sandwiched.

Figure 6:
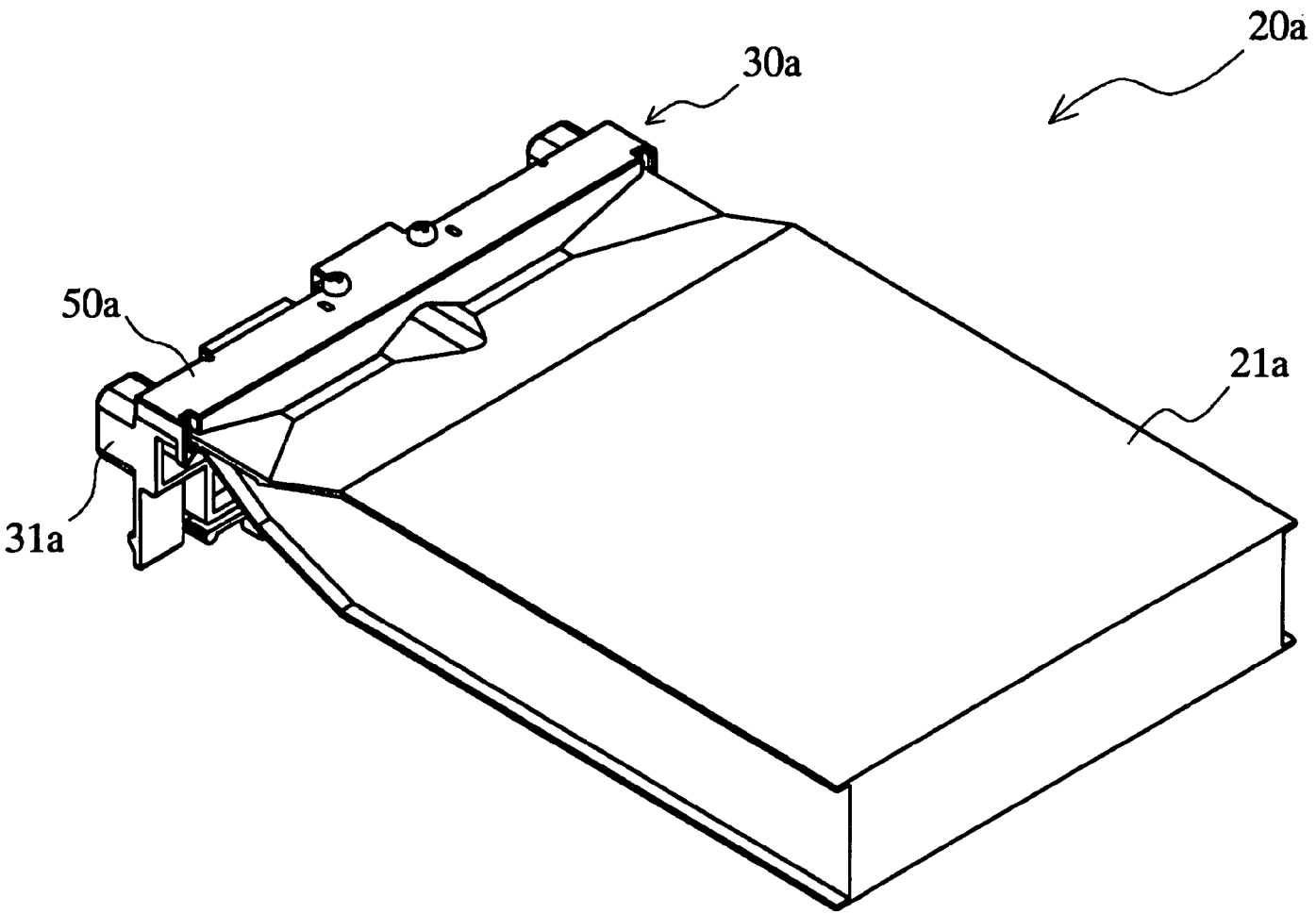
FIG. 6 is a view illustrating an ink bag unit according to a modification example.

FIG. 6 is a perspective view illustrating a state where an ink bag unit 20*a* according to this modification example is viewed from the oblique rear.

A construction of the ink bag 21*a* is similar to that of the ink bag 21. Note that, though the rear end bonded portion 26 (FIG. 2B) is not formed on a rear of the ink bag 21*a*, a construction may be adopted, in which the rear end bonded portion 26 is formed.

An adapter portion 30*a* is attached to a front of the ink bag 21*a*, and the front end bonded portion 22 (FIG. 3A) is sandwiched and pressed by a stopper 50*a* and a collar member 31*a* from upper and lower sides.

Figure 7A:
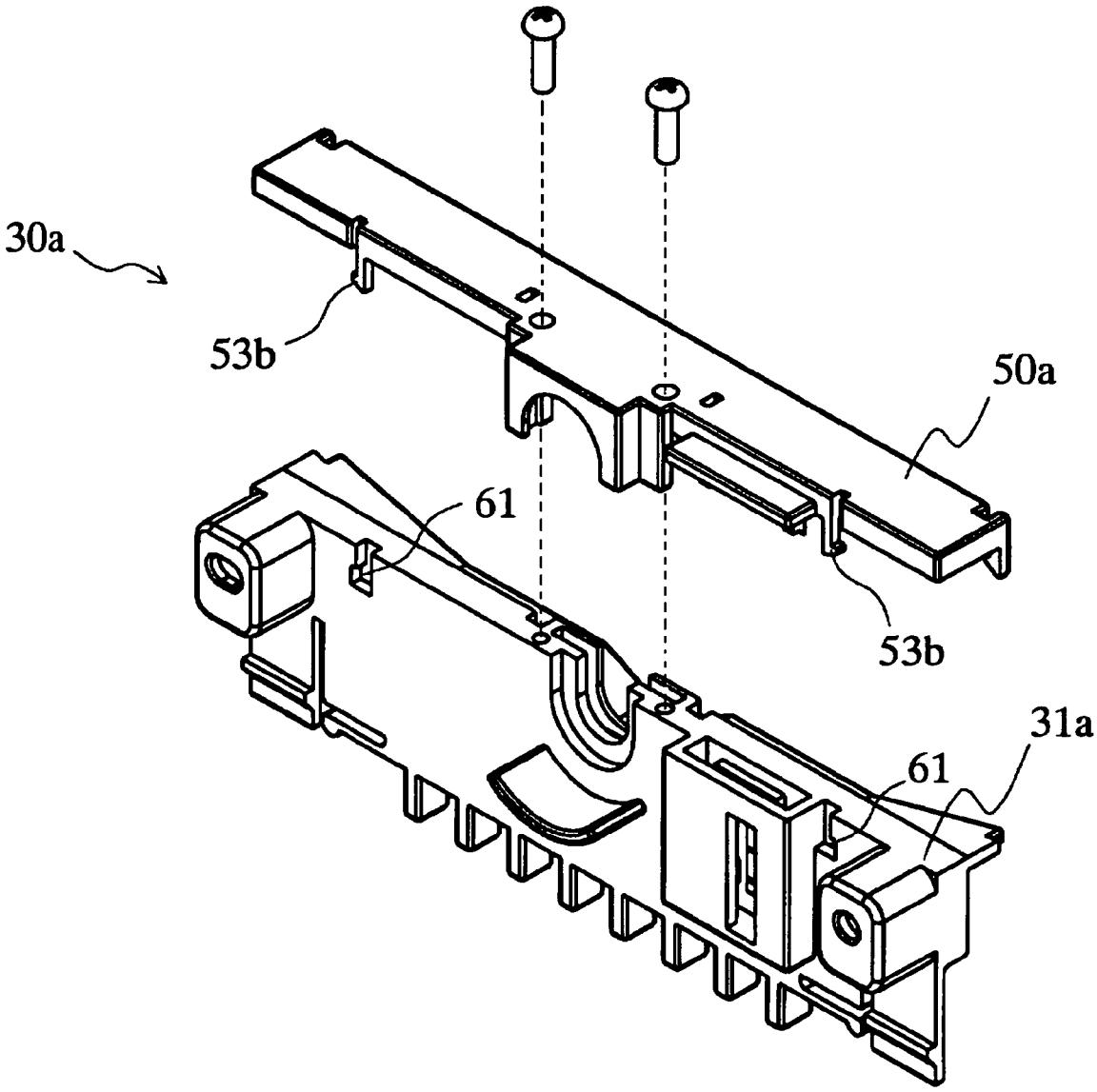

FIG. 7A is a perspective view illustrating a construction of the adapter portion 30*a*, illustrating a state where the adapter portion 30*a* is viewed from the front.

The stopper 50*a* has a shape in which both ends of the stopper 50 (FIG. 3B) are extended in a longitudinal direction of the collar member 31*a*, and stopper fixing hooks 53*b* are formed on the front surface thereof.

Further, at the time when the stopper 50*a* is attached to the collar member 31*a*, the stopper fixing hooks 53*b* engage with recessed portions 61 formed on the collar member 31*a*.

Figure 7B:
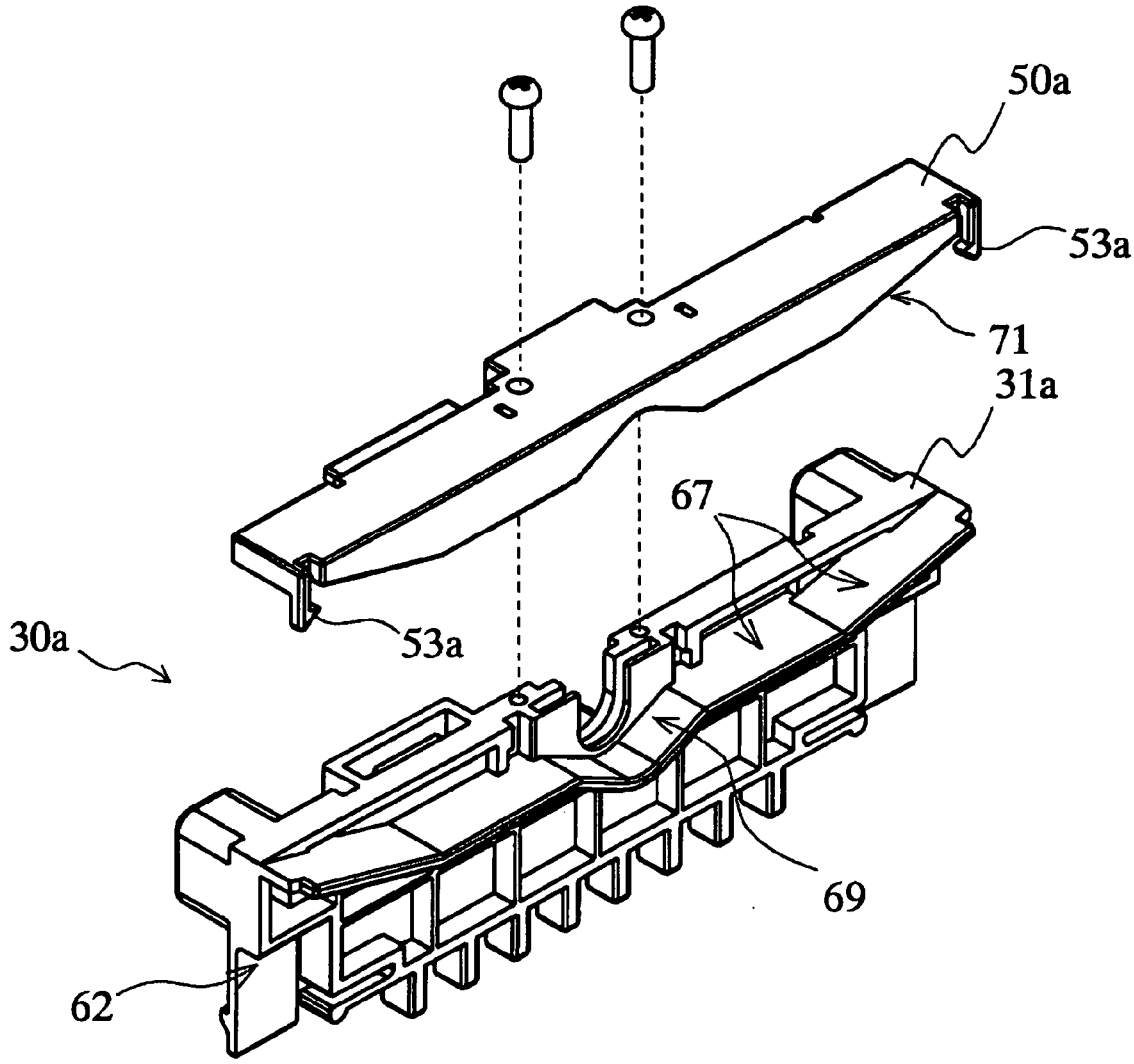

FIG. 7B is a perspective view illustrating a state where the adapter portion 30*a* is disassembled, illustrating a state where the adapter portion 30*a* is viewed from the rear.

On both ends of the stopper 50*a*, stopper fixing hooks 53*a* are formed. At the time when the stopper 50*a* is attached to the collar member 31*a*, the stopper fixing hooks 53*a* engage with collar portions 62 of end portions of the collar member 31*a*.

On the collar portion 31*a*, there are formed: bonded portion retaining portions 67 which overhang rearward from a plate surface of the collar member 31 and are brought into surface contact with the front end bonded portion 22 (FIG. 3A); and a boat-shaped retaining portion 69 that is formed substantially into the shape of the boat-shaped portion 29 and is brought into contact with the boat-shaped portion 29.

Meanwhile, on a region of the stopper 50*a*, which is opposed to the bonded portion retaining portions 67 and the boat-shaped retaining portion 69, a retaining portion 71 having a shape corresponding to those of the bonded portion retaining portions 67 and the boat-shaped retaining portion 69 is formed.

Then, when the stopper 50*a* is fixed to the collar member 31*a*, the front end bonded portion 22 and boat-shaped portion 29 of the ink bag 21*a* are sandwiched and pressed by the bonded portion retaining portions 67, the boat-shaped retaining portion 69, and the retaining portion 71, and are thereby held in a sandwich manner.

As described above, those members function as pressing portions which press the bonded portion, by which the ink bag is hermetically sealed, and thereby hold the bonded portion in a sandwich manner.

Note that, on surfaces of the bonded portion retaining portions 67 and the boat-shaped retaining portion 69, for example, a cushion member such as rubber is provided. The cushion member is warped by urging force of the retaining portion 71, whereby the entirety of the front end bonded portion 22 can be held in a sandwich manner by uniform force, and a non-slip function is exerted.

The stopper 50*a* can be screwed to the collar member 31*a* in a direction of pressing the front end bonded portion 22, and by fastening by such screwing, the front end bonded portion 22 can be held in a sandwich manner by sufficient urging force.

With regard to the ink bag 21*a*, the entire edge thereof extending from the boat-shaped portion 29 to the front end bonded portion 22 can be held in a sandwich manner by the stopper 50*a* and the collar member 31*a*, whereby strength of the boundary portions 23, the front end bonded portion 22, and the boat-shaped portion 29 can be reinforced.

In particular, the boundary portions 23 located on boundaries between the front end bonded portion 22 and the boat-shaped portion 29 are the weakest portions. However, the boundary portions 23 and the vicinity thereof are held in a sandwich manner, whereby the boundary portions 23 can be reinforced effectively.

Note that other functions of the collar member 31*a* and the stopper 50*a* are similar to those of the collar member 31 and the stopper 50, which are mentioned above.

According to the modification example described above, such effects as described below can be obtained.

(1) The front end bonded portion 22 and the boat-shaped portion 29 are held in a sandwich manner. In such a way, even in the case where large force acts on those regions by the fall thereof, those regions can be prevented from tearing.

(2) The stopper 50*a* is screwed to the collar member 31*a* in the direction of holding the front end bonded portion 22 in a sandwich manner, whereby the sufficient urging force can be obtained.

(3) The front end bonded portion 22 is held in a sandwich manner while interposing the cushion member, whereby the entirety of the front end bonded portion 22 can be held in a sandwich manner by the uniform force, and the non-slip function can be exerted.

What is claimed is:

1. An ink bag adapter, comprising:

an ink bag fixing portion fixed to a predetermined portion of an ink bag that reserves ink supplied to an ink ejection head;

an ink bag container fixing portion fixed to a predetermined portion of a tray-shaped ink bag container that houses the ink bag and is mounted on a printing apparatus;

a recessed portion or a protruding portion for each ink type of the fixed ink bag and that coincides with a corresponding protruding portion or recessed portion of the printing apparatus at a time when the ink bag container is mounted to the printing apparatus; and a storage medium holding portion that, when fixed to the ink bag container, holds a storage medium that stores information regarding the ink in the fixed ink bag at a predetermined position, wherein the ink bag container fixing portion includes a stopper and a collar member that are fixed together to form a pressing portion that presses a bonded portion of the ink bag that hermetically seals the ink bag, the bonded portion of the ink bag includes a front end portion, a boat-shaped portion, and a boundary portion between the front end portion and the boat-shaped portion, the pressing portion holds the front end portion, the boat-shaped portion and the boundary portion sandwiched between the stopper and the collar member, the storage medium holding portion and the recessed portion or protruding portion of the ink bag adapter are provided on the collar member, and the ink bag container fixing portion is fixed to the ink bag fixing portion.

2. An ink bag adapter according to claim 1, wherein the predetermined portion of the ink bag is an ink supply port that supplies the ink from the ink bag.

3. An ink bag adapter according to claim 1, wherein a shape of the ink bag container fixing portion corresponds to each ink type of the fixed ink bag, and the ink bag container fixing portion is fixed to a predetermined ink bag container that is adapted to the shape.

4. An ink bag adapter according to claim 1, further comprising a positioning portion that is fitted to a fitting portion formed in the printing apparatus and positions the ink bag container at a time when the ink bag container is mounted to the printing apparatus, the positioning portion being fitted to a fitting portion that corresponds to the positioning portion.

5. An adapter-equipped ink bag, comprising:

an ink bag that reserves ink supplied to an ink ejection head; and the ink bag adapter according to claim 4, the ink bag adapter being fixed to a predetermined portion of the ink bag.

6. A printing apparatus, comprising: an ink bag container mounting means for mounting thereon an ink bag container that houses the adapter-equipped ink bag according to claim 5;

predetermined information acquiring means for acquiring predetermined information regarding the ink of the ink bag from a storage medium held on an ink bag adapter fixed to the mounted ink bag container;

determining means for determining whether or not to use the ink of the ink bag, to which the ink bag adapter is fixed, by using the acquired predetermined information; and printing means for performing printing on a printing medium by ejecting the ink reserved in the ink bag from an ink ejection head to the printing medium in a case where the determining means determines to use the ink.

7. An adapter-equipped ink bag, comprising:

an ink bag that reserves ink supplied to an ink ejection head; and the ink bag adapter according to claim 3, the ink bag adapter being fixed to a predetermined portion of the ink bag.

8. A printing apparatus, comprising: an ink bag container mounting means for mounting thereon an ink bag container that houses the adapter-equipped ink bag according to claim 7;

predetermined information acquiring means for acquiring predetermined information regarding the ink of the ink bag from a storage medium held on an ink bag adapter fixed to the mounted ink bag container;

determining means for determining whether or not to use the ink of the ink bag, to which the ink bag adapter is fixed, by using the acquired predetermined information; and printing means for performing printing on a printing medium by ejecting the ink reserved in the ink bag from an ink ejection head to the printing medium in a case where the determining means determines to use the ink.

9. An adapter-equipped ink bag, comprising:

an ink bag that reserves ink supplied to an ink ejection head; and the ink bag adapter according to claim 2, the ink bag adapter being fixed to a predetermined portion of the ink bag.

10. A printing apparatus, comprising: an ink bag container mounting means for mounting thereon an ink bag container that houses the adapter-equipped ink bag according to claim 9;

predetermined information acquiring means for acquiring predetermined information regarding the ink of the ink bag from a storage medium held on an ink bag adapter fixed to the mounted ink bag container;

determining means for determining whether or not to use the ink of the ink bag, to which the ink bag adapter is fixed, by using the acquired predetermined information; and printing means for performing printing on a printing medium by ejecting the ink reserved in the ink bag from an ink ejection head to the printing medium in a case where the determining means determines to use the ink.

11. An adapter-equipped ink bag, comprising:

an ink bag that reserves ink supplied to an ink ejection head; and the ink bag adapter according to claim 1, the ink bag adapter being fixed to a predetermined portion of the ink bag.

12. A printing apparatus, comprising: an ink bag container mounting means for mounting thereon an ink bag container that houses the adapter-equipped ink bag according to claim 11;

predetermined information acquiring means for acquiring predetermined information regarding the ink of the ink bag from a storage medium held on an ink bag adapter fixed to the mounted ink bag container;

determining means for determining whether or not to use the ink of the ink bag, to which the ink bag adapter is fixed, by using the acquired predetermined information; and printing means for performing printing on a printing medium by ejecting the ink reserved in the ink bag from an ink ejection head to the printing medium in a case where the determining means determines to use the ink.

13. An ink bag adapter that attaches to a front end bonded portion of an ink bag which contains ink and which has a spout for supplying ink from the ink bag and that removably attaches the ink bag to a tray that is mounted to a printing apparatus so that the ink bag adapter and ink bag can be removed as a unit from the tray and replaced by another ink bag adapter and ink bag, the ink bag adapter comprising:

a collar member having front and rear sides, a spout-receiving recess extending through the collar member and shaped to receive therein a part of the ink bag spout, and a retaining portion extending along the rear side of the collar member including along the region of the spout-receiving recess for retaining one side of the front end bonded portion of the ink bag; and a stopper member attachable to the collar member and having a spout-receiving recess shaped to receive therein another part of the ink bag spout, and a retaining portion extending along the underside of the stopper member including along the region of the spout-receiving recess for retaining the other side of the front end bonded portion of the ink bag and coacting with the retaining portion of the collar member to sandwich therebetween and press from opposite sides the front end bonded portion of the ink bag when the stopper member is attached to the collar member.

14. An ink bag adapter according to claim 13; wherein the collar member includes a fixedly positioned storage medium holding portion that holds a storage medium containing information concerning the ink in the ink bag.

15. An ink bag adapter according to claim 14; wherein the storage medium holding portion has an opening that opens at the front side of the collar member to effect electrical connection between the storage medium and circuitry in the printing apparatus when the ink bag is removably attached to the tray and the tray is mounted to the printing apparatus.

16. An ink bag adapter according to claim 15; wherein the storage medium is formed on an IC chip having an electrode that is exposed through the opening to effect electrical connection between the electrode and circuitry in the printing apparatus when the ink bag is removably attached to the tray and the tray is mounted to the printing apparatus.

17. An ink bag adapter according to claim 13; wherein the collar member has collar fixing portions that engage with recessed portions on both end sides of the tray to attach the collar member to the tray.

18. An ink bag adapter according to claim 13; wherein the collar member has protrusions or recesses on the front side thereof that coincide with correspondingly shaped recesses or protrusions of the printing apparatus when the ink bag is removably attached to the tray and the tray is mounted to the printing apparatus.

19. An ink bag adapter accordingly to claim 18; wherein the position or shape of the protrusions or recesses of the collar member correspond to an attribute of the ink in the ink bag.

* * * * *